US005249860A

United States Patent [19]

Buschbom et al.

[11] Patent Number: 5,249,860

[45] Date of Patent: Oct. 5, 1993

[54] MATERIAL MIXER

[75] Inventors: Eldon F. Buschbom, Minnetonka; Kenneth G. Connaughty, Rushford, both of Minn.

[73] Assignee: J-Star Industries, Inc., Fort Atkinson, Wis.

[21] Appl. No.: 821,405

[22] Filed: Jan. 15, 1992

[51] Int. Cl.[5] ..... B01F 15/02; B01F 9/02

[52] U.S. Cl. ..... 366/135; 366/156; 366/186

[58] Field of Search ..... 366/20, 157, 220, 54, 366/62, 131, 133, 135, 136, 156, 186, 233

[56] References Cited

U.S. PATENT DOCUMENTS

| | | | |
|---|---|---|---|
| 1,708,947 | 4/1929 | Jaeger . | |
| 3,552,721 | 1/1971 | Phillips . | |
| 3,712,494 | 1/1973 | Lindeborg . | |
| 4,423,961 | 1/1984 | Steiner . | |
| 4,451,154 | 5/1984 | Zimmerman | 366/135 |
| 4,487,507 | 12/1984 | Wyngaarden | 366/220 |
| 4,500,209 | 2/1985 | Steiner et al. . | |
| 4,797,004 | 1/1989 | Buschbom . | |

OTHER PUBLICATIONS

"Orbit-Mixer", Van Dale publication, Apr. 1988.

*Primary Examiner*—Robert W. Jenkins
*Attorney, Agent, or Firm*—Godfrey & Kahn

[57] ABSTRACT

A bulk material mixing apparatus has an inclined drum rotatably mounted on a frame supporting a hopper for directing bulk materials in the drum. An auger extended along a trough conveys materials toward the upper inlet end of the drum into a discharge chute or back into the drum. An elongated bar positioned above the auger provides an even distribution and flow rate of materials into the auger trough. A hydraulic motor drives the auger connected to a planetary gear drive used to rotate the drum whereby the motor concurrently drives the auger and drum to mix bulk materials placed in the drum. A hopper attachment having a feed auger is adapted to be mounted on the hopper to handle large amount of bulk material.

34 Claims, 11 Drawing Sheets

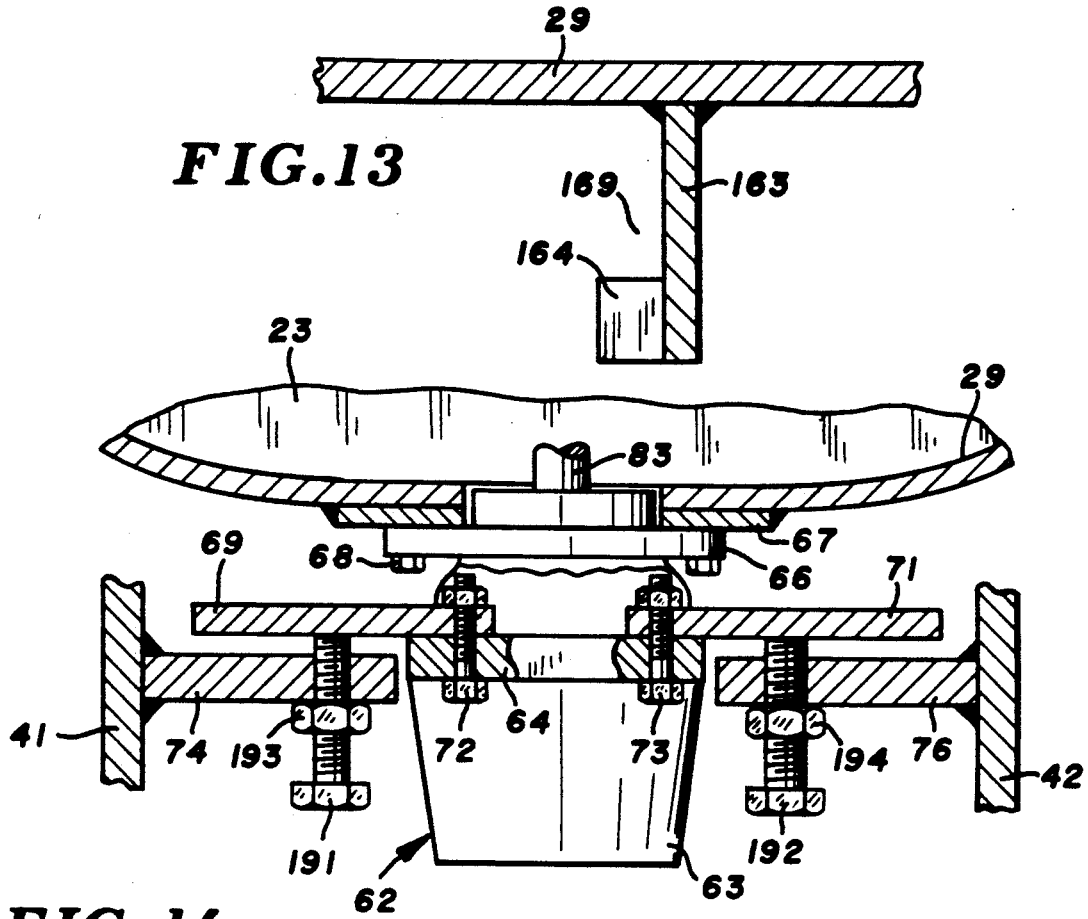
FIG.13
FIG.14
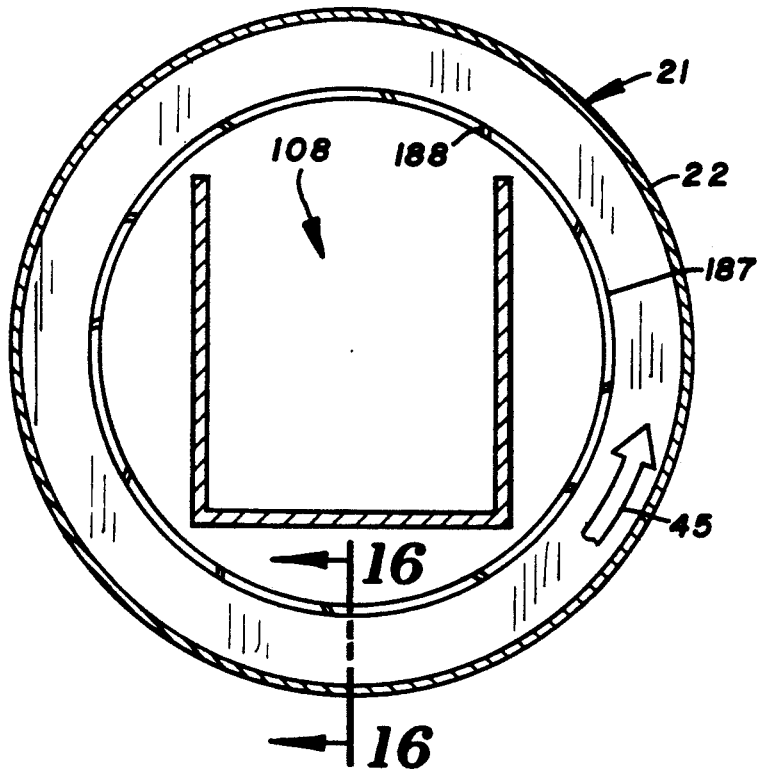
FIG.15

MATERIAL MIXER

FIELD OF THE INVENTION

The invention is in the field of batch bulk material mixing machines having inclined drums which rotate to mix bulk materials, such as animal rations, and augers to remove the mixed bulk materials from the drums.

BACKGROUND OF THE INVENTION

A material mixer having an inclined rotatable drum for mixing animal feeds is disclosed by F. E. Buschbom in U.S. Pat. No. 4,797,004 issued Jan. 10, 1989. A longitudinal auger extended along a trough is located within the drum to carry feed from the lower end of the drum into a hopper or alternatively back into the mixing chamber. The conveyor trough is angularly tilted to regulate the volume of feed conveyed by the auger. The tilting of the trough does not break up bunches or accummulations of feed and therefor does not provide for an even flow of feed under all conditions. A chain and sprocket drive adjacent the lower end of the drum operates to concurrently rotate the auger and drum. In use the chain and sprocket drive places rotational or torque forces on the drum and frame supporting the drums. The rotational speeds of the auger and drum cannot be changed as the electric drive motor operably coupled to the chain and sprocket drive operates at a given speed. The mixer also has a flexible sealing belt biased into engagement with a fixed circular bead. The belt moves along the bead which causes wear on the belt. The belt can also bend outwardly which opens the seal allowing feed to flow out under the hopper. The hopper has a top opening to allow feeds to be placed into the mixer. The hopper does not accommodate a conveyor and trough assembly for directing large amounts of feed into the drum. The bulk material mixer of the invention overcomes the disadvantages of the material mixer disclosed in U.S. Pat. No. 4,797,004.

SUMMARY OF THE INVENTION

The invention relates to an apparatus for mixing bulk materials, such as granular, particulates, semi-fluid products and liquids, discharging the mixed materials outside of the apparatus. The bulk materials include animal rations having grains, silage, haylage, minerals and liquid or granular concentrates. Other types of bulk materials can be mixed in the apparatus.

The apparatus has an inclined drum having a material mixing chamber. The drum is rotatably mounted on a frame. The inlet end of the drum has an opening accommodating a hopper which directs material from filling equipment into the mixing chamber. The lower rear end of the drum is closed with a rear wall. A conveyor located longitudinally in the mixing chamber is driven by a motor mounted on the hopper. The rear end of the conveyor is connected to a drive unit operably connected to the drum to rotate the drum concurrently with the conveyor to mix material in the mixing chamber. The motor for driving the conveyor can be mounted on the drive unit in lieu of the hopper. A bar located above and generally parallel to the conveyor restricts the flow of materials into the conveyor and provides generally even distribution of materials in the conveyor. The bar also keeps excessive weight of materials off the conveyor which reduces binding and wear of the conveyor and reduces the power required to operate the conveyor. The conveyor moves material toward the inlet end of the drum and selectively discharges the material back into the mixing chamber or into a discharge chute that carries the materials to a selected location outside the apparatus.

A preferred embodiment of the apparatus is a feed mixer for mixing materials, such as animal rations. The mixer has an inclined cylindrical drum having a mixing chamber including an inlet end annular wall surrounding an opening into the mixing chamber and a closed end wall. A hopper having a top opening is mounted on a frame adjacent the inlet end annular wall. The hopper has an outwardly extended member located adjacent an inside portion of the annular wall. A ring on the annular wall extends toward the member to minimize the escape of materials from the drum. The position of the drum and hopper relative to each other is adjustable to adjust the clearance between the ring and member. Rollers and a planetary gear drive unit rotatably support the drum on the frame for rotation about the longitudinal inclined axis of the drum. To mix the materials in the mixing chamber an elongated U-shaped trough accommodating a mixing auger is located within the mixing chamber. The trough has an open top to accommodate materials that fall downwardly in the mixing chamber. A motor, such as a hydrualic fluid operated motor, mounted on the hopper or the planetary gear drive unit, is driveably connected to the auger to rotate the auger which moves materials toward the inlet end of the drum. The auger is connected to the planetary gear drive unit so that the motor concurrently rotates the auger and drum. The auger, planetary gear drive unit, and motor are in axial alignment thereby eliminating unequal forces on the frame during operation of the mixer. The operating speed of the motor is controlled with a valve which is adjusted by the operator of the mixer. An elongated bar supported on stands attached to the trough is located above and generally parallel to the auger. The bar restricts the flow of materials into the trough and provides for a generally even distribution of materials in the trough which enhances uniform mixing of materials in the mixing chamber. The bar is self cleaning as it is free to rotate on support sleeves. In use the bar keeps excessive amounts of materials off the auger thereby reducing weight of materials on the auger, reducing binding and wear of the auger and trough, and reducing the amount of power required to rotate the auger. The lateral position of the bar on the stands can be changed to alter its interference with the flow of materials into the trough. The planetary gear drive unit is adjustably mounted on the frame to allow vertical adjustment of the drum relative to the hopper. The hopper is adjustably mounted on the frame to permit horizontal adjustment of the hopper relative to the drum. These adjustments are used to adjust the clearance between the ring and member to effectively seal the space between the annular wall and member to prevent escape of materials from the mixing chamber.

Another embodiment of the apparatus for mixing materials has a material feeder mounted on the hopper for handling large loads of materials that are dumped into feeder. The feeder has a trough with an open top and a center opening into the hopper. A feed auger having two opposite turned flights is rotated with a hydraulic fluid operated motor to move materials in the trough into the hopper and mixing chamber. The speed of rotation of the feed auger can be regulated to ensure an even flow of materials into the mixing chamber. The hcpper pivotally supports a door which when closed allows the materials discharged by the mixing auger to recycle in the mixing chamber. When the door is open the materials are discharged by the mixing auger into a discharge chute which directs the materials to a selected location.

The details and further advantages of the apparatus for mixing materials are embodied in the following detailed description and drawings.

FIG. 13 is an enlarged sectional view taken along the line 13—13 of FIG. 12;

FIG. 14 is an enlarged sectional view taken along the line 14—14 of FIG. 3;

FIG. 15 is a sectional view taken along the line 15—15 of FIG. 7;

DESCRIPTION OF PREFERRED EMBODIMENT

Figure 1:
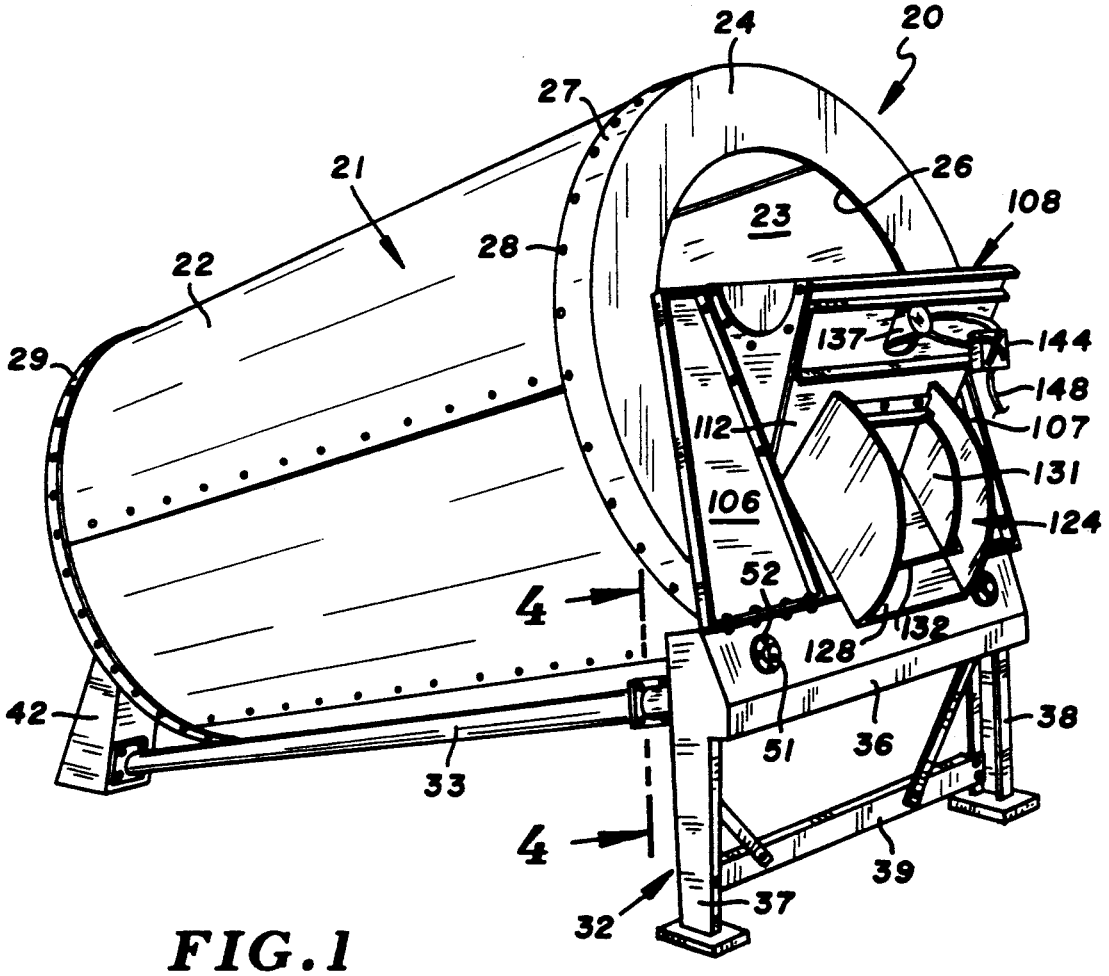
FIG. 1 is a perspective view of the material mixer of the invention.
Figure 2:
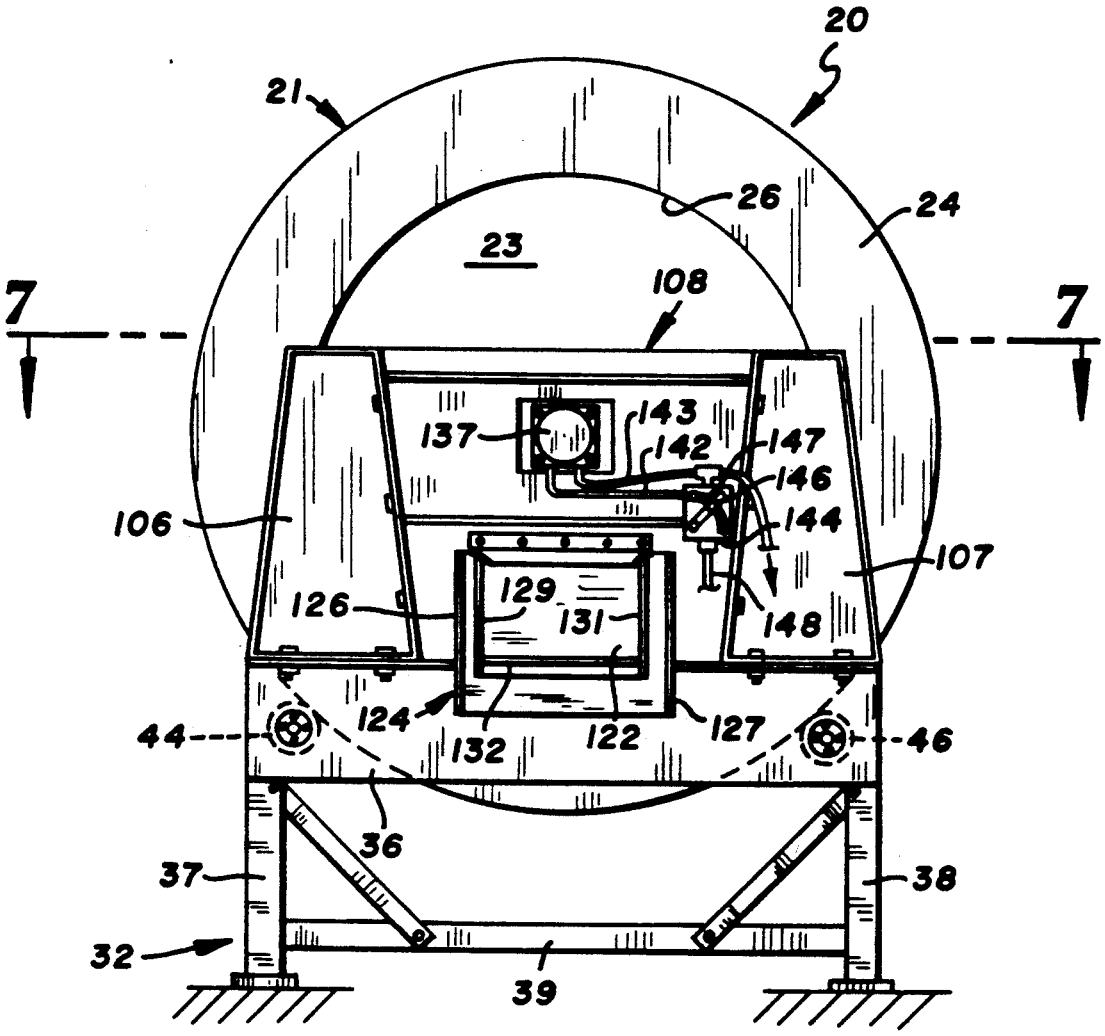
FIG. 2 is an enlarged view thereof.
Figure 3:
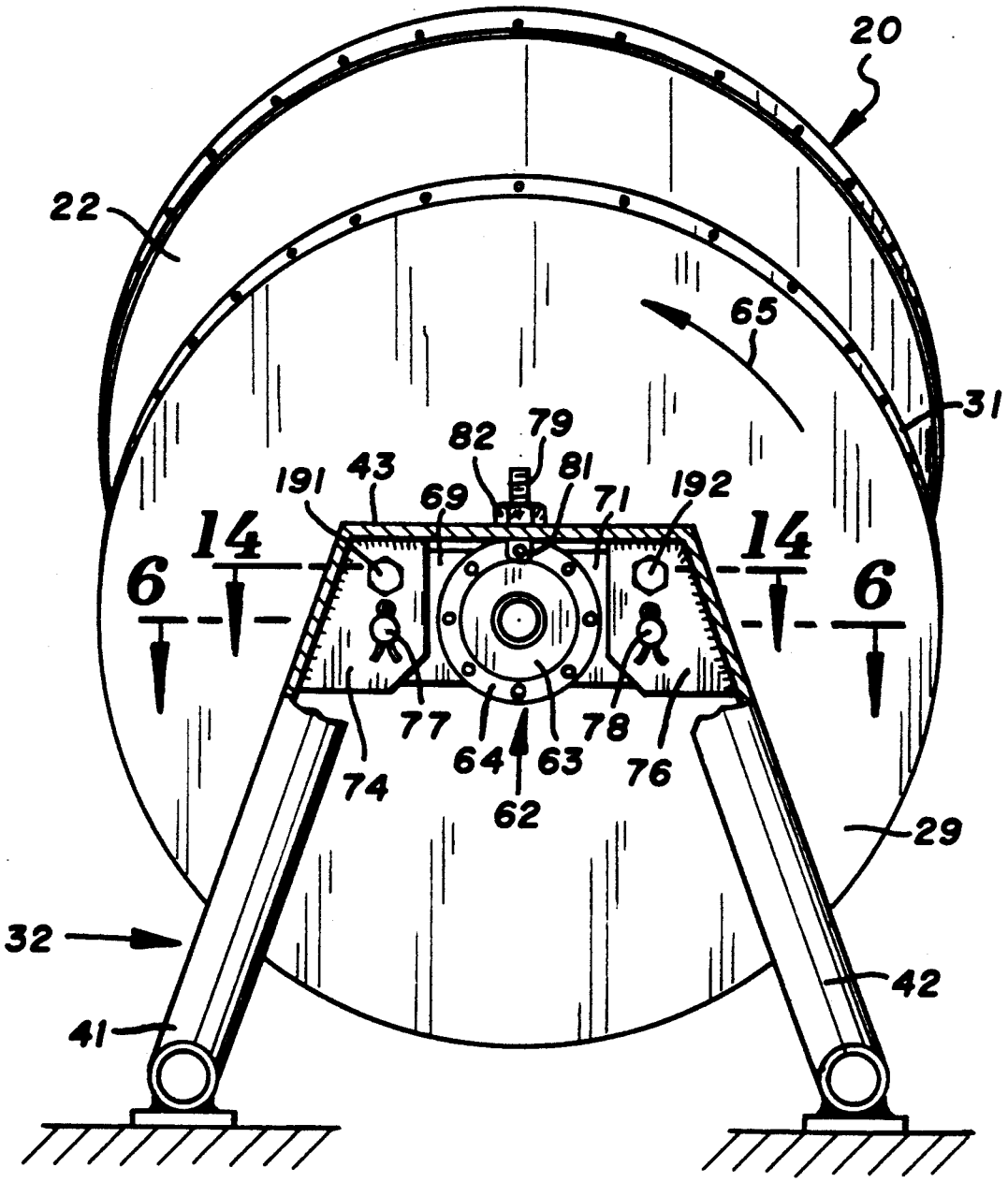
FIG. 3 is an enlarged rear view thereof partially sectioned to show the planetary gear unit of the mixer.

Refering to FIGS. 1-3, there is shown a bulk material mixing apparatus indicated generally at 20 for mixing bulk materials, such as animal rations including ground grains, minerals, feed supplements, silage and haylage, and discharge the mixed bulk materials to a selected location such as a conveyor which moves the materials to feed lots or a vehicle to transport the mixed materials to a feed lot. The apparatus operates to consistently mix the bulk materials in a relatively short period of time. The discharge rate of the mixed materials can be changed by the operator of the apparatus to accommodate the capacity of the take away equipment. The mixed materials are completely conveyed from the apparatus in a fast and efficient manner.

Figure 5:
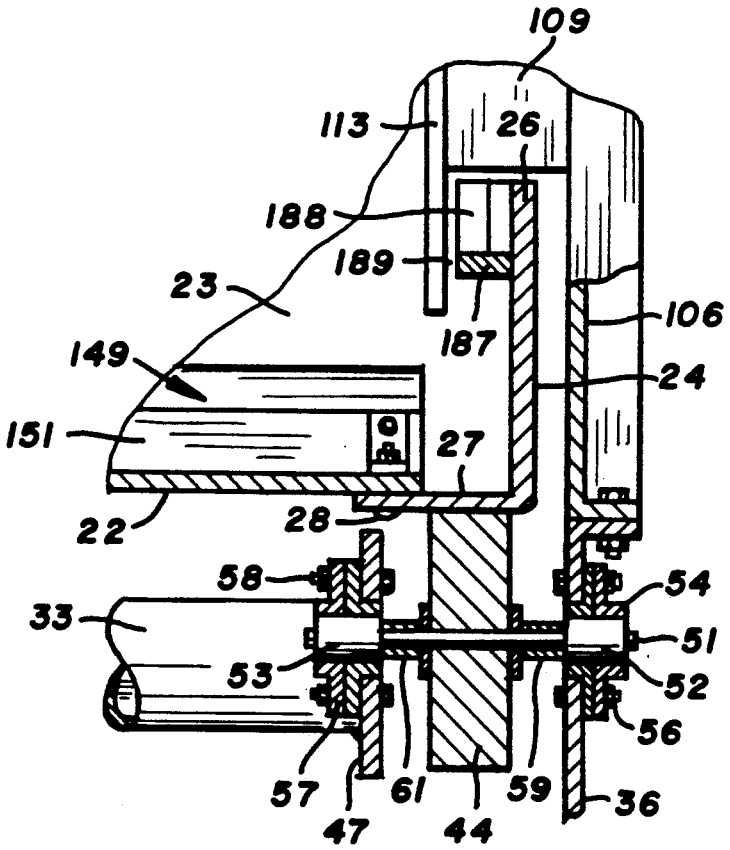
FIG. 5 is a an enlarged sectional view taken along the line 5—5 of FIG. 4.

The apparatus is a mixer 20 having a large elongated inclined cylindrical drum indicated generally at 21 for accommodating and mixing the bulk materials. Drum 21 has a large cylindrical side wall 22 surrounding a mixing chamber 23. An annular front wall 24 is secured to side wall 22 to partially close the front end of drum 21. Front wall 24 has an opening 26 to allow the bulk materials to be placed into mixing chamber 23. As seen in FIGS. 1 and 5, front wall 24 has a circumferential circular rim 27 that is secured with a plurality of bolts 28 to side wall 22. Referring to FIG. 3, drux 21 has a rear wall or dome 29 that closes the rear end of mixing chamber 23. A plurality of bolts 31 secure rear wall 29 to side wall 22.

Drum 21 is rotatably mounted on a frame indicated generally at 32. Frame 32 can be supported on a surface such as a floor or be operatively connected to a balance beam mechanical scale or digital electronic scale for precise loading of the rations into mixing chamber 23. Frame 32 has a pair of side beams 33 and 34 connected to a front cross plate 36. A pair of upright legs 37 and 38 locate cross plate 36 above the supporting surface and provide drum 21 with a downwardly and rearwardly inclination. The bottom portions of legs 37 and 38 are connected to a cross beam 39 to vertically stabilize the legs 37 and 38. Referring to FIG. 3, a pair of downwardly diverging rear legs 41 and 42 join to a top member or beam 43 to support the rear of drum 21 as herein after described. Beams 33 and 34 are connected to the lower portions of rear legs 41 and 42.

Figure 4:
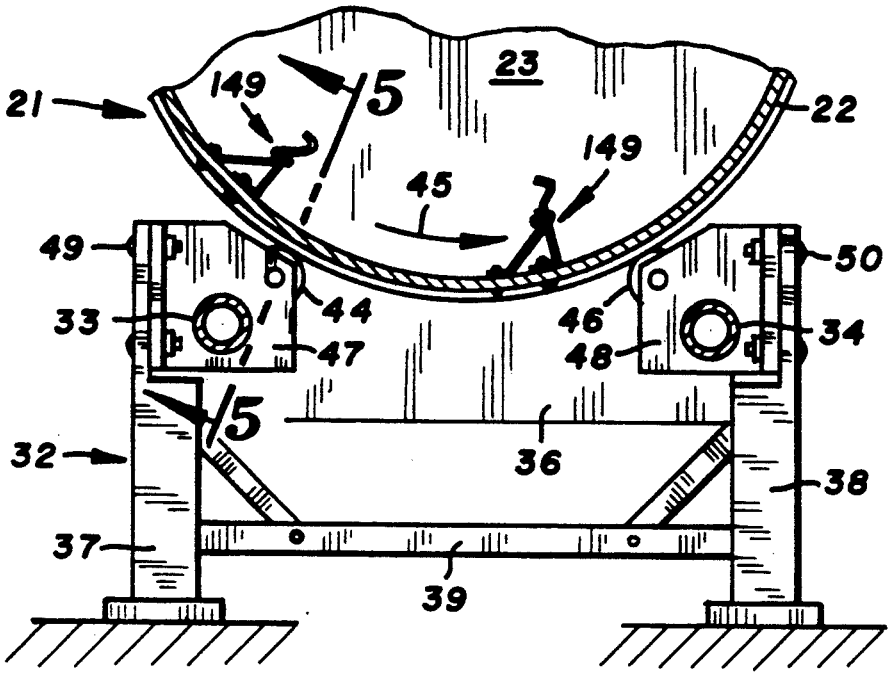
FIG. 4 is a sectional view taken along the line 4—4 of FIG. 1.

Referring to FIG. 4, drum 21 is rotatably supported on a pair of rollers 44 and 46 to allow drum 21 to be rotated in the direction of arrow 45 to mix materials in the mixing chamber 23. Rollers 44 and 46 are rotatably mounted on plates 36, 47 and 48. Bolts 49 attach plate 47 to the upper end of leg 37. Bolts 50 attach plate 48 to the upper end of leg 38. The forward ends of beams 33 and 34 are secured with welds to plates 47 and 48.

Referring to FIG. 5, there is shown the shaft structure for rotatably mounting roller 44 on plates 36 and 47. Roller 44 is secured to a shaft 51 with a key so that shaft 51 rotates with roller 44. Opposite ends of shaft 51 are rotatably mounted in sleeve bearings 52 and 53. Bearing holder plates 54 surrounding bearing 52 are secured to plate 36 with a plurality of bolts 56. Bearing 53 is held by bearing holder plates 57 secured to plate 47 with bolts 58. Spacer sleeves 59 and 61 space opposite sides of roller 44 from plates 36 and 47. The outer cylindrical surface of roller 44 rides on circular rim 27 of drum 21 thereby rotatably supporting drum 21 on roller 44. The structure for rotatably mounting roller 46 on plates 36 and 48 is the same as shown in FIG. 5.

Figure 6:
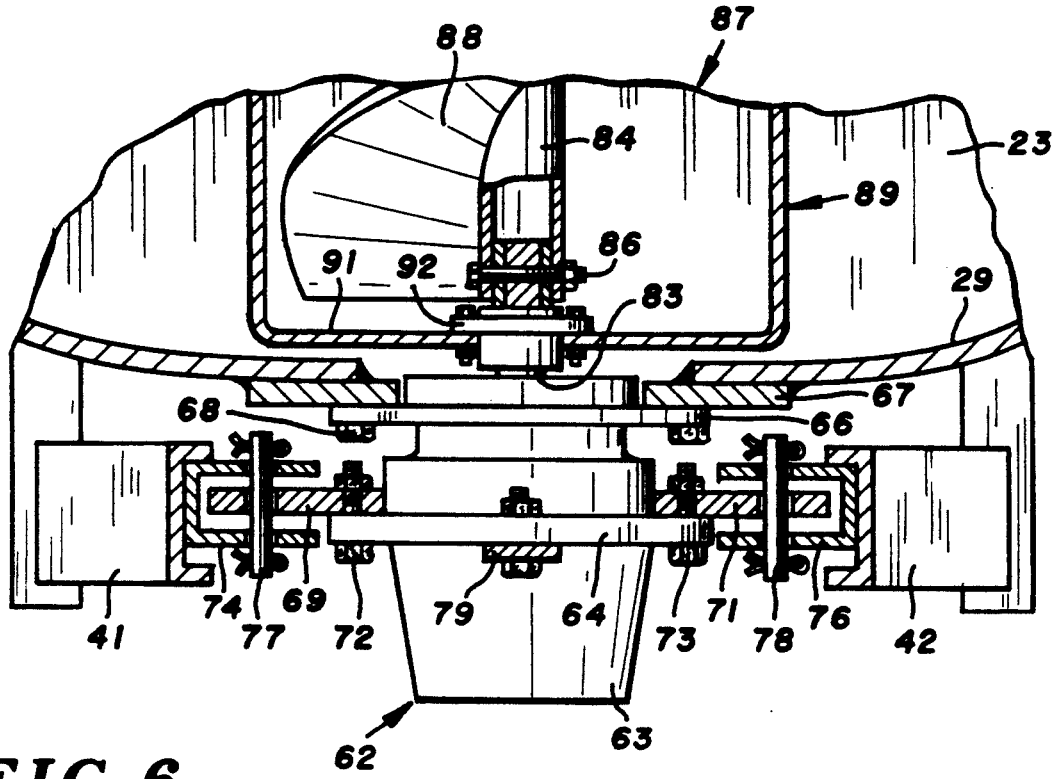
FIG. 6 is an enlarged sectional view taken along the line 6—6 of FIG. 3.

Referring to FIG. 6, planetary gear unit 62 has a housing 63 and an outwardly directed annular flange 64 joined to the mid-section of housing 63. Planetary gear unit 62 is a commercial product. An example of the planetary gear unit is the Model 8 power wheel planetary gear drive manufactured by the Auburn Gear Company, Auburn, Ind. 46706. Planetary gear unit 62 is an enclosed structure to prevent contamination from outside materials, dirt and dust, whereby the planetary gear unit has a long operating life with minimum maintenance and repair. The forward end of gear unit 62 has a rotatable annular member or ring 66 located adjacent an annular plate 67 secured to rear end wall 29. Member 66 is rotatably mounted with bearings (not shown) on housing 63. A plurality of bolts 68 secure ring 66 to plate 67 so that on operation of planetary gear unit 62 drum 21 is rotated in the direction of arrow 65 as seen in FIG. 3. Flange 64 is located adjacent upright plates or members 69 and 71. Bolts 72 and 73 attach plates 69 and 71 to opposite diametric sides of flange 64. Plates 69 and 71 overlap support pairs of members 74 and 76 fixed to the upper ends of legs 41 and 42 and cross member 43, as seen in FIG. 3. Pins 77 and 78 extend through aligned holes in plates and members 69, 74 and 71, 76 to support planetary gear unit 62 on rear frame legs 41 and 42. Pins 77 and 78 have releasable retainers, such as cotter keys, which can be removed to allow pins 77 and 78 to be removed from the plates and members 69, 74 and 71, 76 thereby allowing the lower end of drum 21 to be lowered to a support surface. This facilitates the installation of planetary unit 62 on the mixer and allows for convenient and quick replacement of planetary unit 62.

Returning to FIG. 3, a holding bolt 79 extended through a center hole in top member 43 is secured to the top of flange 64 with a connector 81 such as a bolt. A nut 82 threaded on the upper end of bolt 79 is used to selectively raise and lower planetary gear unit 62 so that the holes in the overlapped plates and members 69, 74 and 71, 76 can be aligned to accommodate pins 77 and 78. Bolt 79 and nut 82 is also used to lower planetary gear unit 62 and rear end of drum 21 relative to frame legs 41 and 42.

As seen in FIG. 14, the positior of gear unit 62 relative to fixed members 74 and 76 is adjusted with a pair of bolts 191 and 192 threaded through members 74 and 76 into engagement with plates 69 and 71. Bolts 191 and 192 are turned to change the longitudinal position of drrm 21 relative to frame 32 for the purpose herein described. Nuts 193 and 194 threaded on bolts 191 and 192 lock bolts 191 and 192 in adjusted positions.

Figure 8:
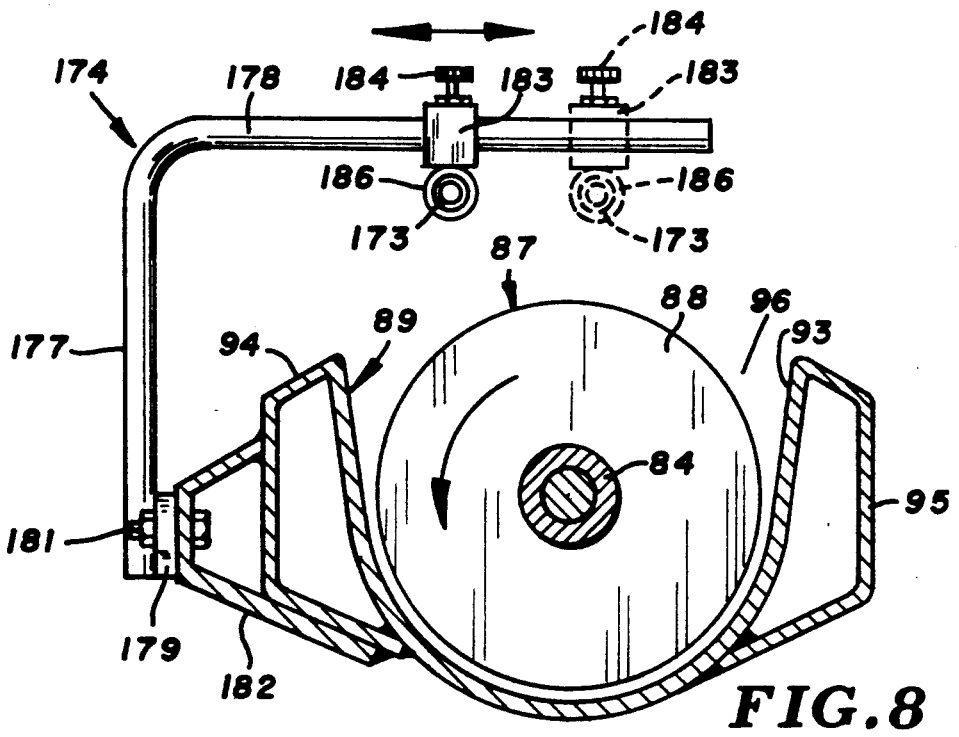
FIG. 8 is an enlarged sectional view taken along the line 8—8 of FIG. 7.

Planetary gear unit 62 has a shaft 83 having one end extended into the mixing chamber 23 as seen in FIG. 6. The opposite end of shaft 83 extends into memter 66. Bearings (not shown) rotatably mount shaft 83 on member 66. Planetary gears drivably connect shaft 83 to member 66 so that when shaft 83 is rotated member 66 rotates at a slower rate of speed. A pin 86 drivably connects a tubular shaft 84 of ar auger indicated generally at 87 to shaft 83 so that shaft 84 driven by hydraulic motor 137 rotates auger 87 and drives plaretary gear unit 62. The longitudinal axes of auger 87 and planetary gear unit 62 are aligned thereby eliminating unequal forces on the frame during operation of the apparatus. Hydraulic motor 137 can be replaced with hydraulic motor 70, seen in FIG. 18, mounted on planetary gear unit 62 to drive planetary gear unit 62 and rotate auger 87 and turn drum 21. Auger 87 includes a continuous helical flight 88 secured to tubular shaft 84. Auger 87 is longitudinally located in a generally U-shaped trough indicated at 89. Trough 89 has a transverse or end wall 91 secured to a bearing 92 that rotatably accommodates shaft 83 whereby the lower end of trough 89 is supported on shaft 83. As shown in FIG. 8, trough 89 has an elongated U-shaped inner wall 93 and side walls 94 and 95 secured to opposite upright portions of inner wall 93. Trough 89 has an open top 96 that extends longitudinally of the mixing chamber 23 for receiving bulk materials that flow downwardly into trough 89. Auger 87 operates to move the materials in trough 89 to the upper or front end of the mixing chamber to either recycle the bulk materials in the mixing chamber or direct the mixed materials into out chute 124.

Figure 9:
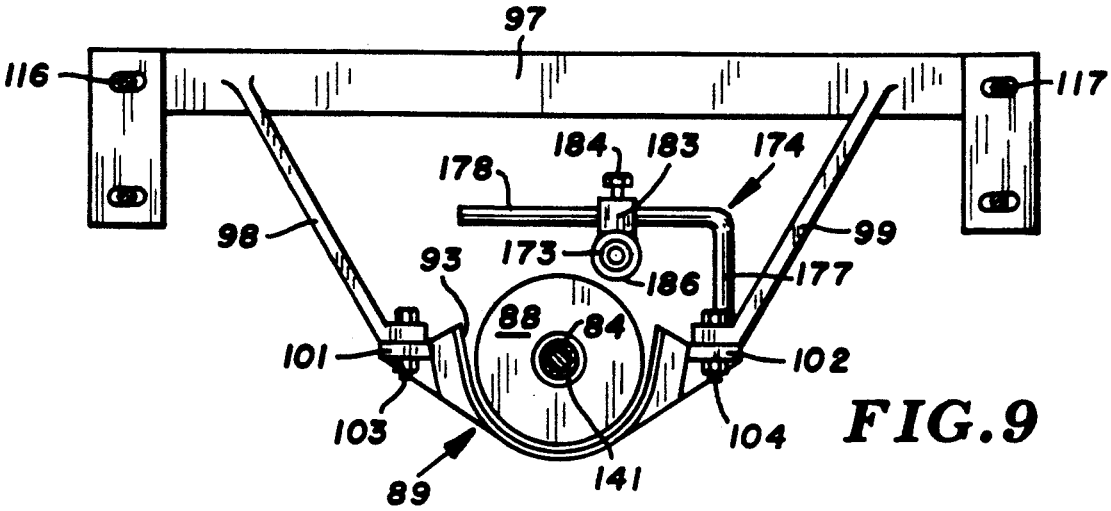
FIG. 9 is a sectional view taken along the line 9—9 of FIG. 7.

Referring to FIG. 9, the front end of trough 89 is supported on a cross beam 97 attached to a pair of downwardly directed arms 98 and 99. The lower ends of the arms 98 and 99 are attached to brackets 101 and 102 with bolts 103 and 104. Brackets 101 and 102 are secured to side walls 94 and 95 of trough 89.

Figure 7:
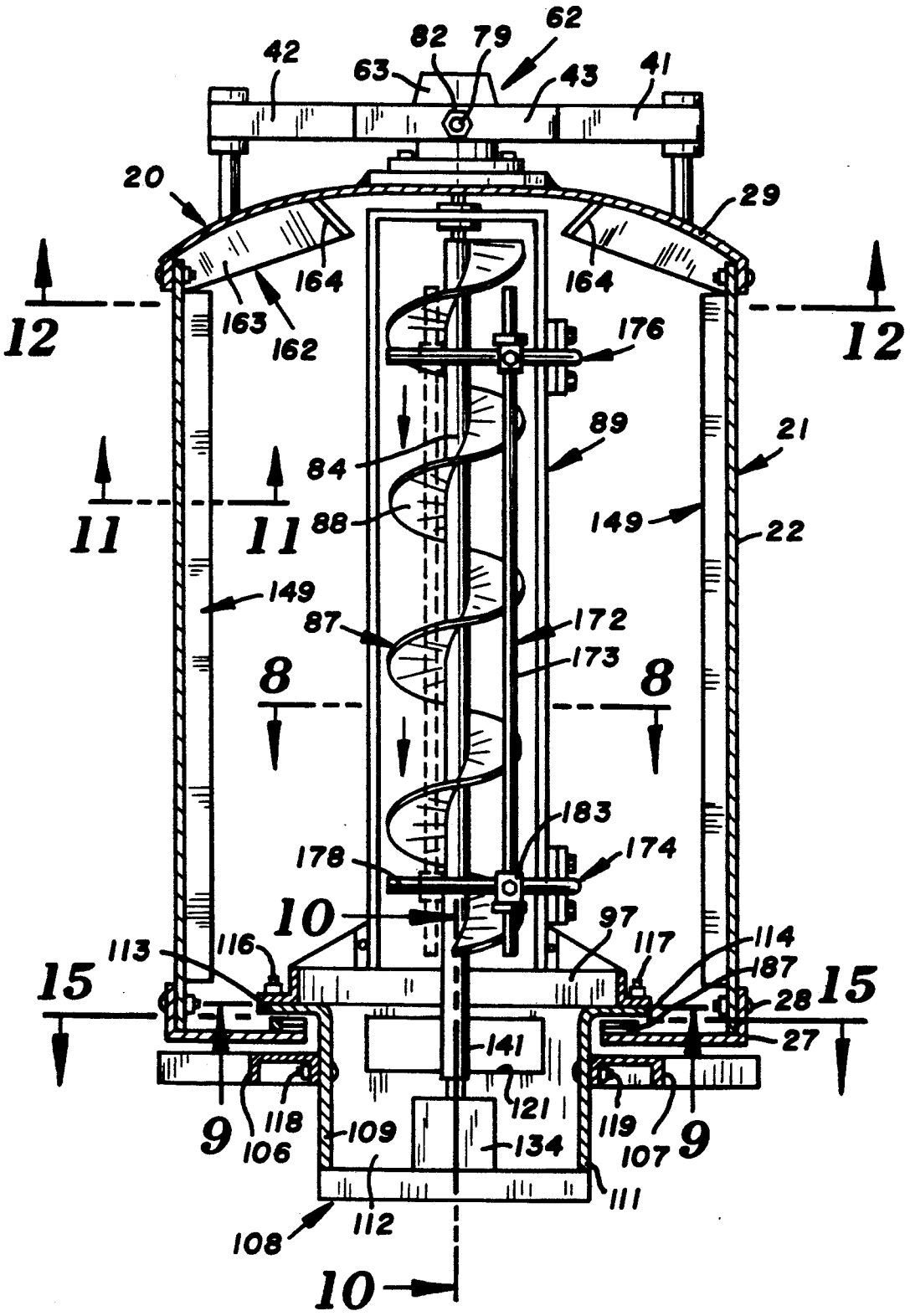
FIG. 7 is a sectional view taken along the line 7—7 of FIG. 2.

Returning to FIG. 2, a pair of upright supports 106 and 107 are secured to the top of the opposite ends of plate 36 adjacent front wall 24 of drum 21. A hopper, indicated generally at 108, having an open top is located between supports 106 and 107 for receiving bulk material and directing the bulk material into mixing chamber 23. Hopper 108 has side walls 109 and 111 as shown in FIG. 7, extended a short distance into mixing chamber 23 and a downwardly and inwardly inclined bottom wall 112 attached to the bottom edges of side walls 109 and 111. Transverse arcuate members 113 and 114 attached to the inner ends of side walls 109 and 111 accommodate bolts 116 and 117 for securing opposite ends of the cross bar 97 to hopper 108. Members 113 and 114 can be a single arcuate or U-shaped plate located adjacent the inside of the lower section of front wall 24 of drum 21. The side walls 109 and 111 of hopper 108 are also secured to upright supports 106 and 107 with bolts 118 and 119. The position of hopper 108 on the frame can be adjusted by relocating the fasteners and bolts 118 and 119 that attach hopper 108 to the frame. This adjustment is used to adjust the locations of members 113 and 114 relative to front wall 24 of drum 21.

Figure 10:
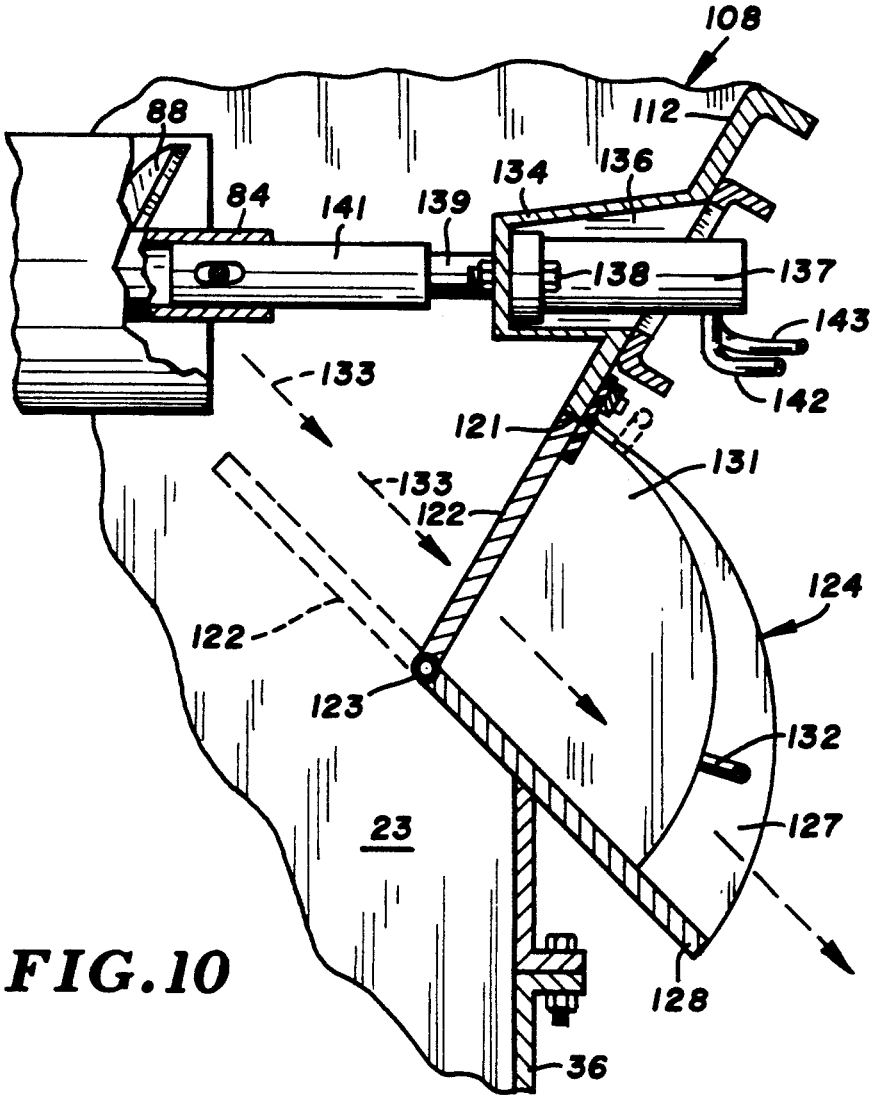
FIG. 10 is an enlarged sectional view taken along the line 10—10 of FIG. 7.

As seen in FIG. 10, the lower pcrtion of the inclined bottom wall 112 of hopper 108 has a generally rectangular opening 121 that is normally closed with a door 122. The lower opposite edges of door 122 accommodate hinge pins 123 which pivotally mount door 122 on bottom wall 112 for movement between open and closed positions, as shown in full and broken lines in FIG. 10. A generally U-shaped discharge chute, indicated generally at 124, is secured to the lower portion of hopper 108 for directing materials that flow though opening 121 externally of the mixer. Discharge chute 124 has a pair of upright side walls 126 and 127 secured to bottom wall 112 adjacent opposite sides of opening 121. A downwardly and outwardly directed bottom wall 128 is joined to the lower edges of side walls 126 and 127 to complete discharge chute 124.

A pair of arcuate walls 129 and 131 are secured to opposite sides of door 122. Walls 129 and 131 extend into the discharge chute 124 adjacent the insides cf walls 126 and 127. A transverse handle 132 is secured to a lcwer portion of walls 129 and 131 to facilitate pivotally movement of door 122 between its open and closed positions. The weight of side walls 129 and 131 along with door 122 will retain door 122 in the closed position as shown in full lines in FIG. 10. When door 122 has been moved to the open position, as shown in broken lines, the weight of door 122 and side walls 129 and 132 will retain door 122 in the open position thereby provide an inwardly generally U-shaped extension of chute 124 for directing materials from the end of auger trough 89, as shown in broker arrows 133 in FIG. 10.

As seen in FIGS. 7 and 10, the upper section of the bottom wall 112 of hopper 108 has an inwardly directed box section 134 forming a recess or pocket 136 accommodating a motor 137. Motor 137 is a hydraulic operated power unit having a drive shaft 139 that is attached to the forward end of auger shaft 84 with a coupling 141. A plurality of bolts 138 attach motor 137 to box section 134. A pair of hoses 142 and 143 are connected to motor 137. Hose 142, as seen in FIG. 2, leads to a control valve 144 mounted on hopper 108 in a position where it is readily usable by the operator of the machine. Valve 144 includes a pressure release bi-pass valve which limits the pressure of hydraulic fluid delivered to motor 137. Motor 137 will stall under extreme heavy loads due to binding of auger 87 or other conditions of the materials in mixing chamber 23 thereby preventing breakage, bending and other damage to the mixer. Control valve 144 has an adjustable control arm 146 that can be moved to selected positions as indicated on a scale or indicia 147 to regulate the speed of operation of motor 137 thereby control the speed of rotation of auger 87. The operator of the mixer adjusts the position of arm 146 so that rate of mixed materials discharged from mixer does not exceed the capacity of the take away equipment that removes the materials from the mixer. A hose 148 is connected to a source of hydraulic fluid under pressure for delivering the hydraulic fluid to control valve 144. Hose 143 is a fluid return line for carrying fluid back to a tank for storing fluid. The fluid flowing through hose 143 can be dumped into a reservoir connected to the fluid pressure supply source. The fluid supply source can be a hydraulic pump driven with a motor such as an electric motor. The pump can be coupled to a tank connected to fluid return line 143. The hydraulic system of an agricultural tractor can be used as a source of hydraulic fluid under pressure to operate the hydraulic fluid motor 137 thereby rotate auger 87 and drum 21. Motor 70 mounted on planetary gear unit 62 can be used in lieu of motor 137 to rotate auger 87 and turn drum 21.

Returning to FIG. 7, drum 21 supports a plurality of inwardly directed longitudinal paddles indicated generally at 149 for carrying materials from the bottom portion of mixing chamber 23 to the top portion thereof to provide for a continuous mixing of the bulk materials within mixing chamber 23. Paddles 149 are secured to the inside of drum side wall 22 and are circumferentially spaced from each other. The number of circumferentially spaced paddles can vary.

Figure 11:
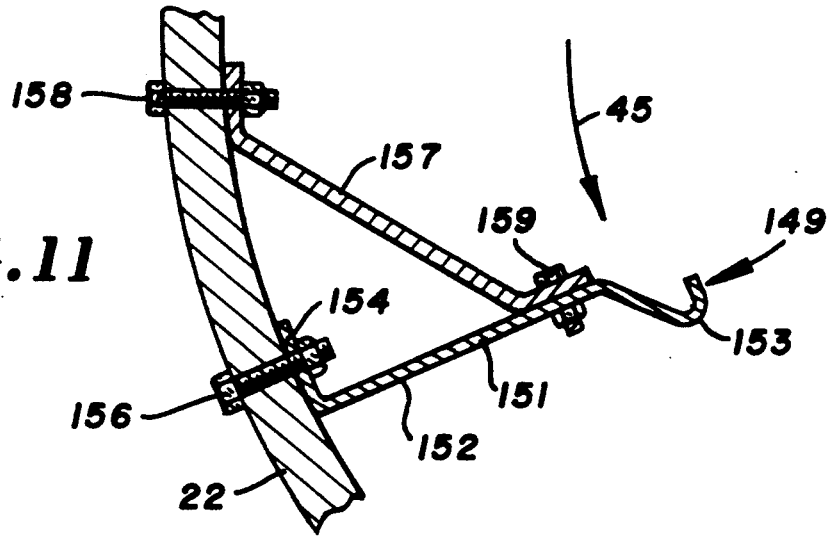
FIG. 11 is an enlarged sectional view taken along the line 11—11 of FIG. 7.

Referring to FIG. 11, paddle 149 has a generally radially directed wall 151 having a smooth front face 152. The outer end of wall 151 has an upwardly and rearwardly directed lip 153. Wall 151 is joined to a base 154 that engages drum side wall 22. A plurality of bolts 156 secure base 154 to drum side wall 22. Wall 151 is reinforced with a plurality of braces 157 attached to drum side wall 22 with a bolt 158 and wall 151 adjacent lip 152 with a bolt 159. Each of the paddles 149 is secured to the inside of drum side wall 22 in the same manner.

Figure 12:
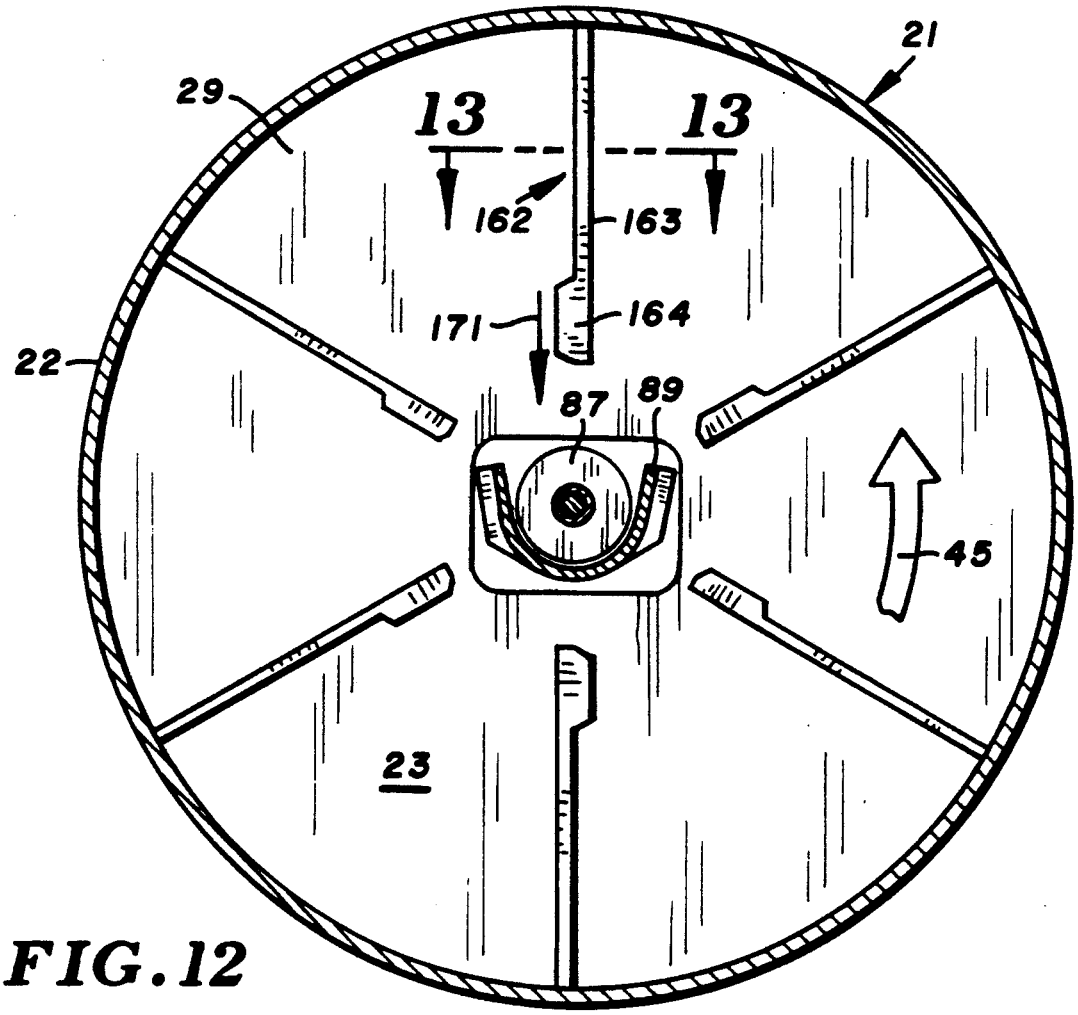
FIG. 12 is an enlarged sectional view taken along the line 12—12 of FIG. 7.

Referring to FIGS. 12 and 13, a plurality of radially fins 162 are located adjacent the inside of back wall 29 of drum 21 for picking up the material in the bottom part of mixing chamber 23 adjacent wall 29 and carrying the materials in an upward direction to deposit the materials in the forward or lower end of trough 89 containing auger 87 which carries the materials to the upper end of mixing chamber 23. Radial fins 162 are circumferentially spaced an equal distance from each other to provide for the quick and effective picking up of the materials and depositing it in trough 89. Each fin 162 has a generally radially flat plate 163 secured to the inside of wall 29 and a tab or member 164 on the outer inside edge of plate 163 which forms a channel or pocket 169 for picking up the materials and carrying the materials from the bottom to the top of mixing chamber 23 to achieve a rapid and efficient full clean out of materials in mixing chamber 23. When fin 162 is in the upper position the materials in pocket 169 falls in a downwardly direction, as indicated by the arrow 171 as seen in FIG. 12, into the open top of trough 89. Auger 87 moves the materials to the front end of mixing chamber 23 where they are discharged into mixing chamber 23 or directed into the discharge chute when door 122 is in its open position.

Apparatus 20 has a material flow control apparatus indicated generally at 172, as shown in FIGS. 7 and 8, for regulating the flow of bulk materials that moves into the open top of trough 89 and allow for an even distribution of bulk materials into auger trough 89. The reduced flow of materials into trough 89 prevents excessive weight cf materials on auger 87, reduces binding and wear of auger 87 and trough 89 and reduces the power required to rotate auger 87. Material flow, control apparatus 172 comprises a generally elongated linear cylindrical bar 173 located above auger 87. Bar 173 extends along an axis that is generally parallel to the axis of rotation of auger 87. As seen in FIG. 7, bar 173 extends substantially the full length of auger trough 89. The rear end of bar 173 is spaced from end wall 29 to allow materials moved by fins 162 to freely flow into the adjacent end of trough 89 to mix and clean out mixed materials in mixing chamber 23. Opposite end portions of bar 173 are supported on stands 174 and 176 secured to side wall 94 of auger trough 89. Stands 174 and 176 are identical in structure. The following description is cf stand 174 shown in FIG. 8. Stand 174 is a generally right angular tubular member having an upright section 177 and a horizcntal section 178 that extends over the top of auger 87. A plate 179 secured to the lower end of upright section 177 accommodates a plurality of bolts 181 to attach the stand to a bracket 182 secured to auger side wall 94. Stands 174 and 176 fix the vertical and lateral orientation of bar 173 relative to auger 87. Bar 173 can be adjusted along the length of the horizontal section 178 as indicated in broken lines in FIG. 8. The lateral position of bar 173 relative to auger 87 determines the distribution and flow rate of the materials that moves into the open top 96 of auger trough 89 and is conveyed by auger 87 to the forward end of mixing chamber 23. Bar 173 is secured to horizontal section 178 with a connector or sleeve 183 that fits over the horizontal section 178 and is adjustably mounted thereon with a lock bolt 184. Sleeve 183 is secured to a collar 186 that surrounds bar 173 whereby bar 173 is mounted on stand 174. Bar 173 is free to rotate on collar 186 whereby bar 173 is self cleaning during mixing of materials in mixing chamber 23.

Figure 16:
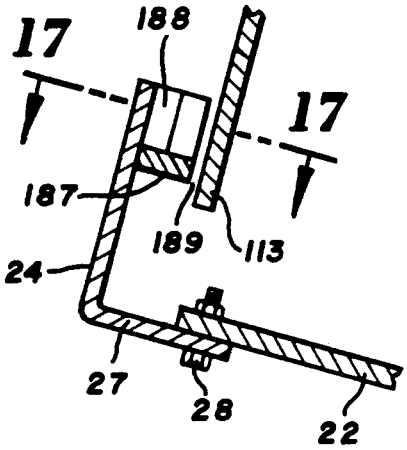
FIG. 16 is an enlarged sectional view taken along the line 16—16 of FIG. 15.
Figure 17:
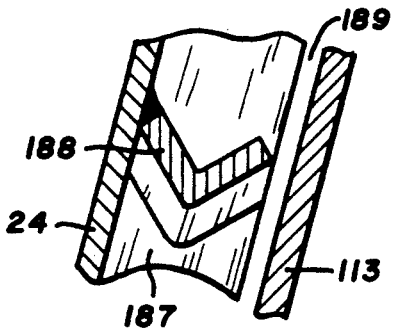
FIG. 17 is an enlarged sectional view taken along the line 17—17 of FIG. 16.

As shown in FIGS. 15–17, a circular ring 187 is secured to the inside of front wall 24 outwardly of the inner edge surrounding opening 26. A plurality of V-shaped paddles 188 extended inwardly from ring 187 adjacent the inside of front wall 24 pick up materials from the space between front wall 24 and members 113 and 114 and allow these materials to fall into hopper 108. The longitudinal position of drum 21 including end wall 24 and ring 187 is adjustable to provide a close clearance space 189 between the inner circular edge of ring 187 and members 113 and 114 of hopper 108. As shcwn in FIG. 14, bolts 191 and 192 are used to adjust the longitudinal position of drum 21 relative to frame 32 thereby adjusting the space between ring 187 and hopper members 113 and 114. Further adjustment of the space between ring 187 and hopper members 113 and 114 is achieved by adjusting the position of hopper 108 on frame 32. Ring 187 and members 113 and 114 function as a seal to minimize the amount of materials that work out of mixing chamber 23 adjacent hopper 108. Paddles 188 clean up materials from adjacent ring 187 and dump these materials back into the top of hopper 108.

Figure 18:
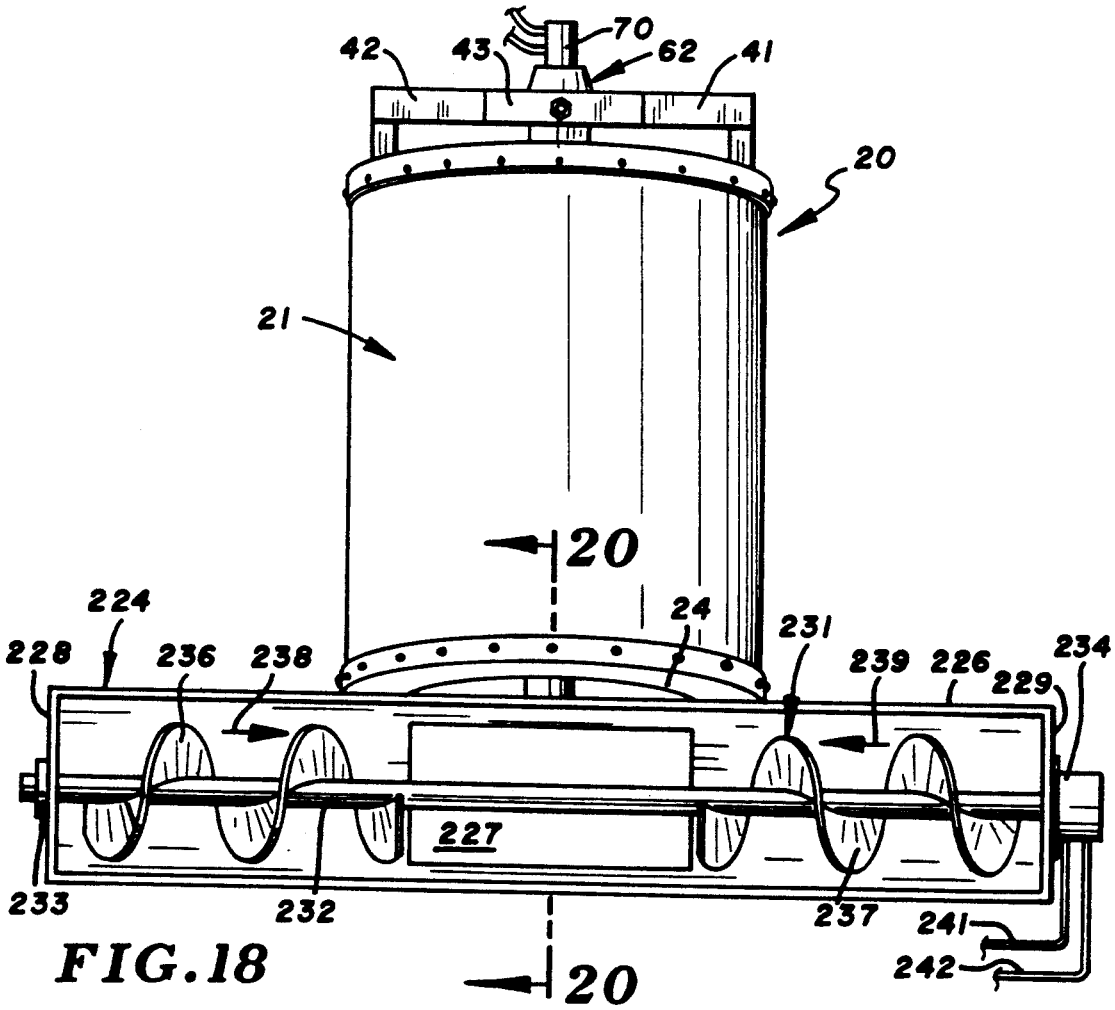
FIG. 18 is a top perspective view of the material mixer of the invention equipped with a material feeder unit.
Figure 19:
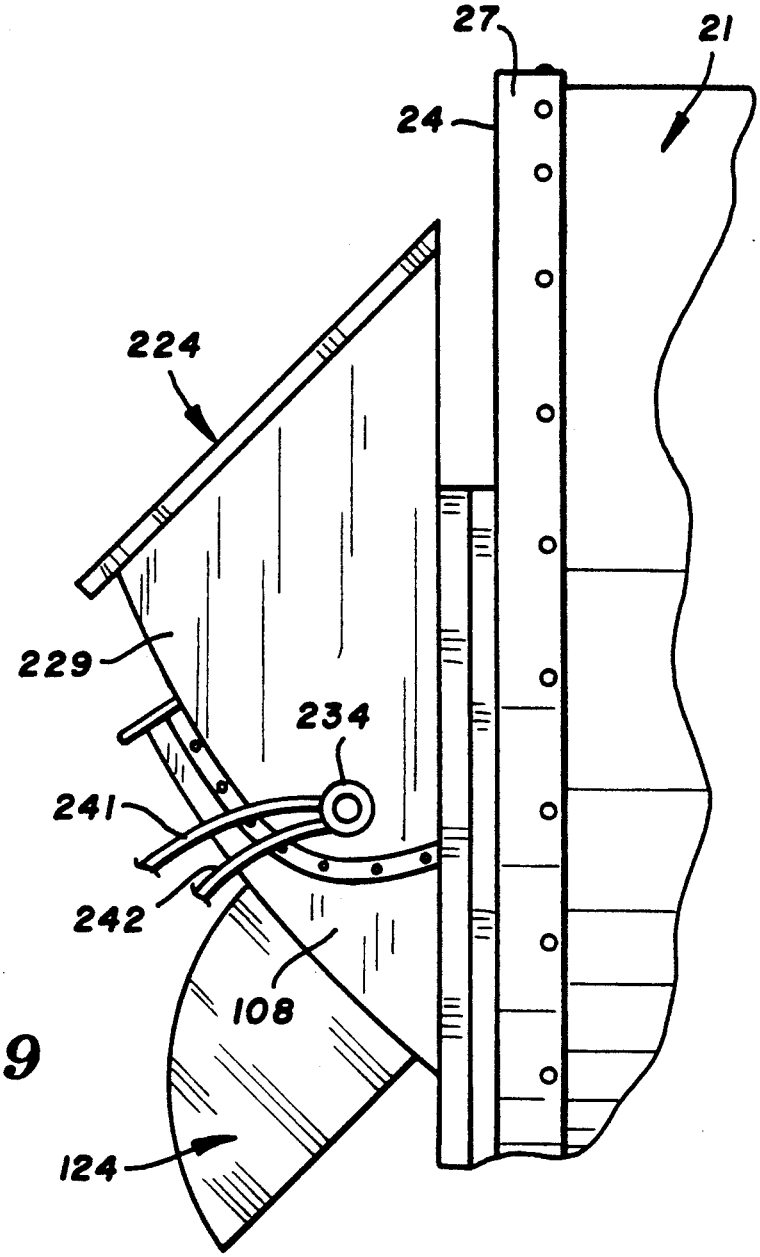
FIG. 19 is an enlarged side view thereof.
Figure 20:
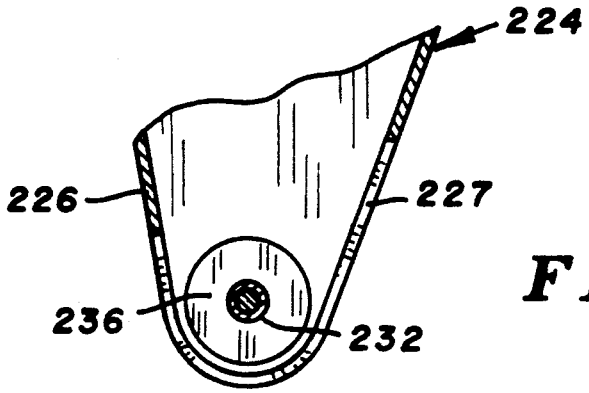
FIG. 20 is a sectional view taken along the line 20—20 of FIG. 18.

Referring to FIGS. 18 to 20, there is shown the bulk material mixing apparatus of the invention with a material feeder unit indicated generally at 224 mounted on hopper 108. Material feeder unit 224 has an elongated transverse trough 226 having a large transverse top opening to permit the operator to load the mixer with a front end loader without material build up or jamming. Trough 226 has a center opening 227 open to hopper 108 to allow materials to flow into mixing chamber 23 of the drum 21. Trough 226 has end walls 228 and 229 for rotatably supporting a transverse feeding auger, indicated generally at 231. Auger 231 has an elongated transverse shaft 232. Shaft 232 has an end located in a bearing 233 mounted on wall 228. The opposite end of shaft 232 is connected to a motor 234 operable in response to hydraulic fluid under pressure to rotate auger 231. First and second helical flights 236 and 237 are secured to shaft 232 on opposite sides of opening 227. Helical flights 236 and 237 are turned in opposite directions so that on rotation of auger 231 the materials will move toward opening 227 as indicated by the arrows 238 and 239. A pair of hydraulic fluid carrying hoses 241 and 242 are connected to hydraulic motor 234 to connect the fluid motor 234 to a source of hydraulic fluid under pressure and a control valve (not shown) for controlling the speed of operation of motor 234 thereby control the speed of operation of auger 231 and movement of materials into mixing chamber 23 of drum 21.

In use, selected animal grains, minerals, concentrates, silage, haylage, and like animal feed materials are placed in hopper 108 or material feeder unit 224 which directs the materials into mixing chamber 23 of drum 21. The ratios of the feed materials are selected by the herdsman as required by the ration requirements of the animals. When the feed materials are placed in mixing chamber 23, drum 21 rotates at a speed to match the filling equipment discharge rate. The operator allows hydraulic fluid under pressure to flow to valve 144 which is adjusted to control the speed of operatior of motor 137. Motor 137 operates to rotate shaft 84 thereby trrning auger 87 to move feed materials along trough 89 to the upper end of mixing chamber 23. Motor 137 also drives planetary gear drive 62 which in turn rotates drum side wall 21. The paddles 149 secured to drum 22 pick up the materials from lower portions of mixing chamber 23 and carry the materials upwardly so that they fall back to the lower portions of the mixing chamber. Soxe of the falling materials hit bar 173 and other materials fall into trough 89. Bar 173 break up clumps of materials to provide for even distribution of materials into trough 89 and uniformity of the mixture of the materials. Bar 173 also restricts the flow of materials into trough 89 thereby reducing weight and amount of materials in trough 89 so as to minimize linding and wear of auger 87 and trough 89 and reduce the power required to rotate auger 87. Drum 21 having a downward and rearward incline causes the materials in mixing chamber 23 to accummulate in the rear portion of mixing chamber 23. Fins 162, shown in FIG. 12, pick up the materials and dump them into auger trough 89 so that auger 87 conveys the material to the front of mixing chamber 23. Fins 162 pick up materials from the lowest part of mixing chamber 23 and deposit them in trough 89 to effectively clean out all of the mixed materials in the mixing chamber during the discharge operation of mixer 20. When door 122 is closed the materials will move down into mixing chamber 23 and continue to be mixed with the materials in mixing chamber 23. When door 122 is open rotating auger 87 discharges the feed materials into out chute 124 which carries the feed materials to a location outside mixer 20. The rate of the mixing operation and discharge of feed materials can be controlled by adjusting valve 144 to regulate the operating speed of motor 137 which concurrently controls the speed of operation of auger 87 and drum 21.

While there has been shown and described several embodiments of the material mixer of the invention, it is understood that changes in the mixer, arrangement of parts and use of the mixer may be made by those skilled in the art without departing from the invention. The invention is defined in the following claims.

We claim:

1. An apparatus for mixing materials comprising: a cylindrical drum having a mixing chamber with a longitudinal axis, an inlet end having an opening open to the mixing chamber, and a closed end for holding materials, hopper means located adjacent the inlet end of the drum for directing materials through the opening into the mixing chamber, a frame for supporting the hopper means, means including planetary gear drive means supporting the drum for rotation on said frame about the longitudinal axis thereof and inclining the drum and the axis downwardly from the inlet end thereof, trough means having an open top located in said mixing chamber, auger means located in said trough means operable to move materials along said trough means toward the inlet end of the drum, drive means mounted on the hopper means for rotating the auger means, said planetary gear drive means having a shaft connected to the auger means and a rotatable member connected to the drum whereby the drive means rotates the auger means and operates the planetary gear drive means to rotate the drum, means mounting the planetary gear drive means on the frame adjacent the closed end of the drum, bar means mounted on the trough means located above and extended generally parallel to the auger means to provide substantially even distribution of materials moving into the trough means and restrict the amount of materials that move into the trough means during rotation of the drum, and means located below the hopper means to allow materials discharged by the auger means from the trough means to selectively flow back into the mixing chamber or flow out of the drum to a selected location.

2. The apparatus of claim 1 wherein: the drive means includes a hydraulic fluid operated motor having a drive shaft connected to the auger means operable to rotate the auger means and drive the planetary gear drive means to rotate the drum, and control valve means for regulating the speed of operation of the motor thereby control the speeds of rotation of the auger means and drum.

3. The apparatus of claim 1 including: first means mounting one end of the trough means on the hopper means and second means mounting the other end of the trough means on the shaft of the planetary gear drive means.

4. The apparatus of claim 1 including: fin means mounted on said closed end of the drum and extended into the mixing chamber for moving material from the lower portion of the mixing chamber and discharging the materials into the trough means during rotation of the drum.

5. The apparatus of claim 1 wherein: the inlet end of the drum has an annular wall, said hopper means has an outwardly directed member located adjacent an inside portion of the annular wall, an annular ring secured to the annular wall extended toward the member to substantially close the space between the annular wall and member to minimize escape of materials through the space between the annular wall and member.

6. The apparatus of claim 5 including: a plurality of paddles extended inwardly from said ring and movable with the annular wall to pick up materials in the space between the annular wall and member and dump the materials into the hopper means.

7. The apparatus of claim 5 including: first means to adjust the location of the ring relative to the member and second means to adjust the location of the member relative to the ring thereby adjust the clearance between the ring and member.

8. The apparatus of claim 7 wherein: the means to adjust the location of the ring includes adjusting means connected to the frame and planetary gear drive means operable to adjust the location of the drum relative to the frame thereby adjust the position of the ring relative to the member.

9. The apparatus of claim 8 wherein: the means mounting the planetary gear drive means includes plate means secured to the planetary gear drive means, said frame including support means located adjacent the plate means, pin means connecting the plate means on the support means whereby the planetary gear drive means is mounted on the support means, said adjusting means being mounted on the support means and engagable with the plate means to adjust the longitudinal location of the drum relative to the frame and hopper mears thereby adjust the position of the ring relative to the member.

10. The apparatus of claim 1 wherein: the means mounting the planetary gear drive means includes plate means secured to the planetary gear drive means, said frame including support members located adjacent the plate means, and pin means connecting the plate means on the support members whereby the planetary gear drive means is mounted on the support members.

11. The apparatus of claim 10 including: means to vertically adjust the planetary gear drive means and plate means relative to the support members when the pin means are removed from the plate means and support members.

12. The apparatus of claim 10 including: adjustable means mounted on the support members engagable with the plate means operable to adjust the longitudinal location of the drum relative to the frame and hopper means.

13. The apparatus of claim 1 including: a plurality of stands mounted on the trough means, each stand having a transverse section extended over the auger means, and connector means mounting the bar means on the transverse section above the auger means, said connector means being adjustably positioned along the length of the transverse section to locate the bar means in a selected position relative to the auger means.

14. The apparatus of claim 13 wherein: the bar means is a single cylindrical member having a length generally the same as the length of the auger means.

15. The apparatus of claim 1 including: material feeder means mounted on the hopper means for directing materials into the hopper means and mixing chamber of the drum.

16. The apparatus of claim 15 wherein: the material feeder means includes a trough having an cpen top mounted on the hopper means, auger means mounted on the trough operable to move materials in the trough into the hopper means and mixing chamber of the drum, and motor means connected to the auger means operable to rotate the auger means whereby the auger means moves materials in the trough into the hopper means and mixing chamber of the drum.

17. An apparatus for mixing materials comprising: a drum having a mixing chamber with a longitudinal axis, an inlet end having an opening open to the mixing chamber and a closed end for accommodating materials and mixing said materials, hopper means located adjacent the inlet end for directing materials through the opening into the mixing chamber, a frame supporting the hopper means, means for supporting the drum for rotation on the frame about the longitudinal axis thereof, means for rotating the drum to mix materials in the mixing chamber, trough means having an open top located in said mixing chamber, auger means located in said trough means cperable to move materials along said trough means toward the inlet end of the drum, drive means for rotating the auger means, bar means mounted on the trough means located above and extended generally parallel to the auger means to provide sulstantially even distribution of materials moving into the trough means and restrict the amount of materials that move into the trough means during rotation of the drum, and means lorated adjacent the hopper means to allow materials discharged from the trough means to selectively flow back into the mixing chamber or flow out of the drum to a selected location.

18. The apparatus of claim 17 wherein: the bar means is a single cylindrical member having a length generally the same as the length of the auger means.

19. The apparatus of claim 17 including: a plurality of stands mounted on the trough means, each stand having a section extended transversely over the auger means, and connector means mounting the bar means on the section above said auger means, said connector means being adjustably positioned along the length of the section to locate the bar means in a selected position relative to the auger means.

20. The apparatus of claim 19 wherein: the bar means is a single cylindrical member having an end spaced from the closed end of the drum to allow materials to flow into the end of the trough means adjacent the closed end of the drum.

21. The apparatus of claim 17 wherein: the rotational axis of the drum is inclined downwardly and rearwardly by the means for supporting the drum on the frame.

22. An apparatus for mixing materials comprising: a drum having a mixing chamber with a longitudinal axis, an inlet end having an opening into the mixing chamber, and a closed end for accommodating materials and mixing said materials, first means located adjacent the inlet end of the drum for directing materials through the opening into the mixing chamber, a frame supporting the first means, second means including planetary gear drive means supporting the drum for rotation on said frame about the longitudinal axis thereof, rotatable conveyor means located in said mixing chamber operable to move materials toward the inlet end of the drum, drive means for rotating the conveyor means, said planetary gear drive means having a shaft connected to the conveyor means and a rotatable member connected to the drum whereby the drive means rotates the conveyor means and operates the planetary gear drive means to rotate the drum to mix materials in the mixing chamber, means mounting the planetary gear drive means on the frame adjacent the closed end of the drum, and means to allow materials discharged by the conveyor means to selectively flow back into the mixing chamber or flow out of the drum to a selected location.

23. The apparatus of claim 22 wherein: the drive means includes a hydraulic fluid operated motor having a drive shaft connected to the conveyor means operable to rotate the conveyor means and drive the planetary gear drive means to rotate the drum, and control means for regulating the speed of operation of the motor thereby control the speed of the conveyor means and drum.

24. The apparatus of claim 22 wherein: the means mounting the planetary gear drive means includes plate means secured to the planetary gear drive means, said frame including support members located adjacent the plate means, and pin means connecting the plate means on the support members whereby the planetary gear drive means is mounted on the support members.

25. The apparatus of claim 24 including: means to vertically adjust the planetary gear drive means and plate means relative to the support members when the pin means are removed from the plate means and support members.

26. The apparatus of claim 24 including: adjustable means mounted on the support members engagable with the plate means operable to adjust the longitudinal location of the drum relative to the frame and hopper means.

27. The apparatus of claim 22 wherein: the conveyor means includes an auger having an auger shaft and a trough having an open top accommodating the auger, said drive means comprising a hydraulic fluid operated motor mounted on the first means having a drive shaft connected to the auger shaft, said shaft of the planetary gear drive means being connected to the auger shaft whereby the hydraulic fluid operated motor concurrently rotates the auger and the drum to mix the materials in the mixing chamber.

28. An apparatus for mixing materials comprising: a drum having a mixing chamber with a longitudinal axis, an inlet end having an annular wall surrounding an opening open to the mixing chamber, and a closed end for accommodating materials and mixing said materials, hopper means located adjacent the inlet end of the drum for directing materials through the opening into the mixing chamber, a frame for supporting the hopper means, means supporting the drum for rotation on the frame about the longitudinal axis thereof, means for rotating the drum to mix materials in the mixing chamber, said hopier means having an outwardly directed member located adjacent an inside portion of the annular wall, an annular ring secured to the annular wall extended toward the member to substantially close the space between the annular wall and member to minimize escape of materials through the space between the annular wall and member, and means to move mixed materials in the mixing chamber to a location outside of the apparatus.

29. The apparatus of claim 28 including: a plurality of paddles extended inwardly from said ring and movable with the annular wall to pick up materials in the space between the annular wall and member and dump the materials into the hopper means.

30. The apparatus of claim 28 including: means to adjust the relative locations of the ring and the member to adjust the clearance between the ring and member.

31. The apparatus of claim 28 wherein: the means for rotating the drum includes a planetary gear drive means, means mounting the planetary gear drive means or the frame, and adjusting means connected to the frame and planetary gear drive means operable to adjust the location of the drum relative to the frame thereby adjust the position of the ring relative to the member.

32. The apparatus of claim 31 wherein: the means mounting the planetary gear drive means ircludes plate means secured to the planetary gear drive means, said frame including support means located adjacent the plate means, pin means connecting the plate means on the support means whereby the planetary gear drive means is mounted on the support means, said adjusting means being mounted on the support means and engagable with the plate means to adjust the longitudinal location of the drum relative to the frame and hopper mears thereby adjust the position of the ring relative to the member.

33. An apparatus for mixing materials comprising: a drum having a mixing chamber with a longitudinal axis, an inlet end having an opening open to the mixing chamber, and a closed end for accommodating materials and mixing said materials, hopper means located adjacent the inlet end of the drum for directing materials through the opening into the mixing chamber, a frame for supporting the hopper means, means for supporting the drum for rotation on the frame about the longitudinal axis thereof, means for rotating the drum to mix materials in the mixing chamber, material feeder means mounted on the hopper means for directing materials into the hopper means and mixing chamber of the drum, said material feeder means includes a trough having an open top mounted on the hopper means, said trough having a first trough section mounted on one side of the hopper means and a second trough section mounted on the other side of the hopper means, auger means mounted on the trough operable to move materials in the trough into the hopper means and mixing chamber of the drum, said auger means having a shaft rotatably mounted on the first and second trough sections and extended across the hopper means, a first helical flight secured to the shaft in the first trough section to move material in the first trough section into the hopper means and mixing chamber, a second helical flight secured to the shaft in the second trough section to move material in the second trough section into the hopper means and mixing chamber, motor means connected to the auger means operable to rotate the auger means whereby the auger means moves materials in the trough into the hopper means and mixing chamber of the drum, and means to move mixed materials in the mixing chamber to a location outside of the apparatus.

34. The apparatus of claim 33 wherein: said motor means being a hydraulic fluid operated motor connected to the shaft for rotating the shaft and first and second helical flights.

* * * * *